US005199757A

United States Patent [19]

Simeth

[11] Patent Number: 5,199,757

[45] Date of Patent: Apr. 6, 1993

[54] GRIPPER FINGER FOR THE GRIPPER SPINDLE OF A SHEET-FED PRINTING PRESS

[75] Inventor: Claus Simeth, Geisenheim-Johannisberg, Fed. Rep. of Germany

[73] Assignee: Man Miller Druckmaschinen GmbH, Geisenheim, Fed. Rep. of Germany

[21] Appl. No.: 746,969

[22] Filed: Aug. 19, 1991

[30] Foreign Application Priority Data

Aug. 18, 1990 [DE] Fed. Rep. of Germany ..... 4026237

[51] Int. Cl.[5] ..... B65H 29/06

[52] U.S. Cl. ..... 294/104; 271/82; 271/277; 101/409

[58] Field of Search ..... 294/104, 106, 902; 271/82, 204, 206, 277; 101/408, 409, 410, 411, 412

[56] References Cited

U.S. PATENT DOCUMENTS

| | | | |
|---|---|---|---|
| 2,882,049 | 4/1959 | Koch | 271/206 |
| 3,536,321 | 10/1970 | Straube | 271/277 |
| 4,253,396 | 3/1981 | Wieland | 271/82 X |
| 4,372.209 | 2/1983 | Jentzsch et al. | 271/82 X |
| 4,647,031 | 3/1987 | Smith et al. | 271/82 |
| 4,718,342 | 1/1988 | Raab et al. | 101/409 |
| 4,781,370 | 11/1988 | Weisgerber . | |
| 4,813,353 | 3/1989 | Raab et al. | 101/410 |
| 4,873,926 | 10/1989 | Simeth et al. . | |
| 4,968,081 | 11/1990 | Beight et al. | 294/104 |

FOREIGN PATENT DOCUMENTS

| | | | |
|---|---|---|---|
| 1174804 | 7/1964 | Fed. Rep. of Germany . | |
| 66634 | 5/1969 | Fed. Rep. of Germany | 271/206 |
| 1908181 | 11/1970 | Fed. Rep. of Germany . | |
| 3526252 | 3/1986 | Fed. Rep. of Germany . | |
| 3632768 | 1/1988 | Fed. Rep. of Germany . | |
| 3623405 | 2/1988 | Fed. Rep. of Germany . | |

*Primary Examiner*—Russell D. Stormer
*Assistant Examiner*—Dean J. Kramer
*Attorney, Agent, or Firm*—Spencer, Frank & Schneider

[57] ABSTRACT

A gripper finger for a gripper spindle in a sheet-fed printing press includes first and second components. The first component has a gripper finger extension which contacts a gripper finger support at a transfer point. The first and second components cooperate to form an enclosure angle for enclosing the gripper spindle, with the first component contributing a maximum of 180 degrees to the enclosure angle and the second component supplementing the enclosure angle. The second component is fastened to the gripper spindle. A first compression spring is disposed between the ends of the first and second for exerting an adjustable, first spring force approximately in a direction of the transfer point. An adjustment screw is threadably engaged with one of the components and has a tip which lies against the supporting plane of the other component for exerting a screw force approximately in a direction of the transfer point. The first spring force and the screw force combine to form a resultant force in the direction of a line connecting the center point of the gripper spindle and the transfer point. A second compression spring clamped between the first component and the gripper spindle urges the first component against the gripper finger with a force greater than the first spring force and in a direction which essentially coincides with the direction of the resultant force.

3 Claims, 5 Drawing Sheets

GRIPPER FINGER FOR THE GRIPPER SPINDLE OF A SHEET-FED PRINTING PRESS

CROSS REFERENCE TO RELATED APPLICATIONS

The present application claims the rights of priority with respect to application Ser. No. P 40 26 237.5 filed Aug. 18th, 1990 in Germany, the subject matter of which is incorporated herein by reference.

BACKGROUND OF THE INVENTION

This invention relates to a gripper finger for a gripper spindle in a sheet-fed printing press.

German Patent No. 3,632,768.C1 and corresponding U.S. Pat. No. 4,873,926 disclose a gripper finger of the above type which includes a first compression spring having an adjustable spring force exerted approximately in the direction of a transfer point of a gripper support, and an adjustment screw whose tip lies against a supporting plane which also exerts a force approximately in the direction of the transfer point. The components are arranged so that the two forces sum to form a resultant force which has a direction coinciding with a vector which approximately connects the center point of the gripper spindle and the transfer point. This arrangement, which insures that the force resulting during operation extends approximately in a line which connects the center of the gripper spindle and the transfer point of the gripper support, gives gripper fingers of this type the significant advantage that practically no change of play occurs in the various operating states.

Such gripper fingers, however, are subject to a relatively great amount of wear, and replacing gripper fingers is an expensive operation. The gripper spindle must be removed as a whole before the worn gripper fingers can be removed from the gripper spindle. This is labor intensive and also leads to presently unacceptably high down times of the machine.

German Patent No. 3,623,405 and corresponding U.S. Pat. No. 4,781,370 disclose a gripper finger which is relatively easy to replace. This gripper finger is made of two parts, a lower gripper finger component and an upper gripper finger component directly thereabove. The ends of the components adjacent to the transfer point are spread apart by a compression spring, and an adjustment screw is provided at the other ends to regulate the distance between the two gripper finger components. Both gripper finger components are fastened to the gripper spindle by means of a screw which passes through a hole in the upper gripper finger component and is screwed into a thread in the gripper spindle. The lower gripper finger component is provided with a recess which has a partially cylindrical profile such that it places itself against the gripper spindle from the same side (upper side) where the upper gripper finger component is also disposed.

Although this prior art gripper finger has the advantage that installation and removal merely require adjustment of the fastening screw, a great change in play results when the gripper is opened and closed and consequently a displacement of the gripper tip results, with the degree of the change in the play and the displacement being dependent on the wear of the gripper bearing. This wear and change in play result in doubling of sheets.

German Patent No. 1,174,804 discloses a gripper finger having a body which covers an opening of about 180 degrees so that installation of this gripper finger also does not require removal of the gripper spindle. The opened body of the gripper finger is closed by a spring with an adjustable spring force. However, this gripper finger still has the above described disadvantages of wear and change in play, particularly because the spring for closing the opening does not pose sufficient resistance in this connection. There is also no provision for realizing the above described important feature of having the forces generated by a compression spring and a contact face combine so that the resultant of these two forces connects the center point of the gripper spindle with the transfer point.

SUMMARY OF THE INVENTION

The object of the present invention is to provide a gripper finger which avoids the above described disadvantages and yet, has the force resulting during operation extending approximately in a line which connects the center of the gripper spindle and the transfer point of the gripper support, and is easily mountable to the gripper spindle, without any change in the play being possible during the various operating states, not even after a longer period of operation.

It is a further object of the invention to provide a gripper finger which has an automatic compensation of play which results when there is wear on the gripper bearing surface and on the gripper spindle, respectively.

The above and other objects are accomplished according to the invention, by the provision of a gripper finger for a gripper spindle in a sheet-fed printing press, comprising: first and second gripper finger components, the first gripper finger component having a first end and a gripper finger extension which contacts a gripper finger support at a transfer point, the second gripper finger component having a second end, one of the first and second gripper finger components presenting a supporting plane, the first and second gripper finger components cooperating to form an enclosure angle for enclosing a gripper spindle, the first gripper component contributing a maximum of 180 degrees to the enclosure angle, and the second gripper component supplementing the enclosure angle such that the enclosure angle is greater than 180 degrees; means for fastening the second gripper finger component to the gripper spindle; a first compression spring, disposed between the first and second ends of the first and second gripper finger components, respectively, for exerting an adjustable, first spring force approximately in a direction of the transfer point; an adjustment screw associated with the other of the first and second gripper finger components and having a tip which lies against the supporting plane of the one gripper finger component for exerting a screw force approximately in a direction of the transfer point so that the first spring force and the screw force combine to form a resultant force which is in a direction of a line connecting a center point of the gripper spindle and the transfer point; and a second compression spring disposed for being clamped between the first gripper finger component and the gripper spindle for urging the first gripper finger component against the gripper finger, the second compression spring exerting a second spring force having a magnitude greater than the magnitude of the first spring force and being in a direction which essentially coincides with the direction of the resultant force.

The two-part configuration of the gripper finger of the invention makes it easily mountable onto and removable from the gripper spindle. The second gripper finger component supplements the first gripper finger component to form a body which, when installed, forms an enclosure angle around the gripper spindle of greater than 180 degrees, so that the gripper finger as a whole is held captive at the gripper spindle.

The first compression spring tends to spread the respective ends of the two gripper finger components apart, while the second compression spring urges the second gripper finger component against the gripper spindle with a greater force so that the arrangement remains stable.

The forces exerted by the first compression spring and the adjustment screw are each along respective lines through the transfer point and sum to form a resultant force which is approximately in a direction of a vector connecting the center of the gripper spindle and the transfer point. The force of the second compression spring extends essentially in the direction of the line connecting the center point of the gripper spindle and the transfer point so that it does not significantly interfere with the resultant force of the first compression spring and of the adjustment screw.

In one embodiment of the invention, the spring force of the second compression spring is adjustable by suitable means. However, in other embodiments, which are structurally simpler, the spring force remains permanently fixed.

The forces exerted on the second gripper finger component become particularly balanced if it is screwed to the gripper spindle at its end facing away from the first compression spring. In any case, it is preferable for the second gripper finger component to be screwed to the gripper spindle and not the first gripper finger component.

According to a further aspect of the invention, the second gripper finger component is received in a recess between lateral flanges of the first gripper finger component so that the second gripper finger component is supported at the first gripper finger component in a particularly simple and also space saving structural arrangement.

Both gripper finger components have contact faces which contact the gripper spindle, and may have a circular profile. However, this arrangement results in such good contact with the gripper spindle that it is preferred for the contact faces of at least one of the two gripper finger components to lie against the gripper spindle in the form of ribs. This causes the formation of narrow contact faces which insure that there is a defined and reproducible contact of the gripper finger with the gripper spindle and which also contributes to the solution provided by the invention.

The invention will now be described in greater detail with reference to the accompanying drawing figures from which further significant features will become evident.

DETAILED DESCRIPTION OF PREFERRED EMBODIMENTS

Figure 1:
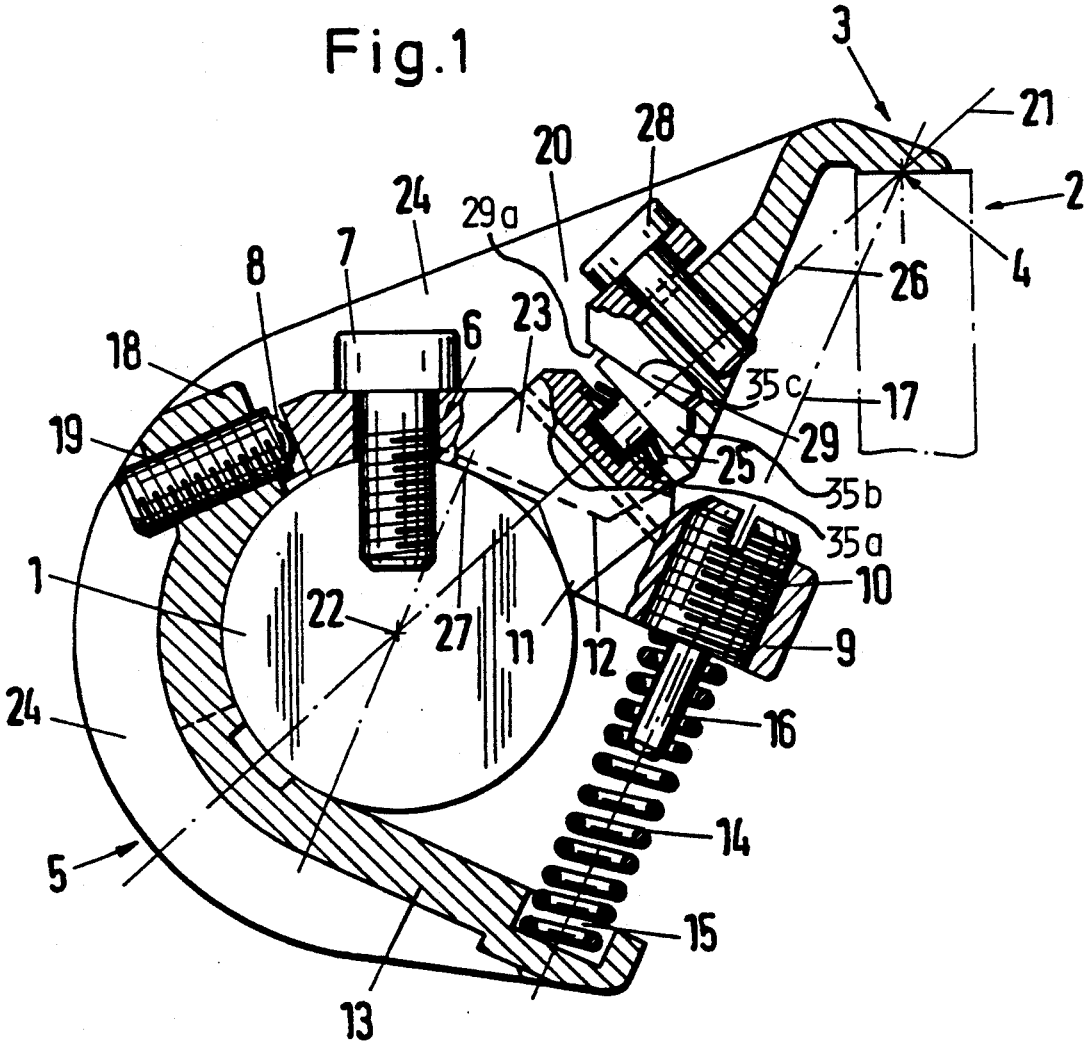
FIG. 1 shows a partially sectional side view of one embodiment of the invention.

Referring to FIG. 1, there is shown a gripper finger, composed essentially of first and second gripper finger components 5 and 6, seated on a gripper spindle 1. First gripper finger component 5 has an essentially U-shaped profile forming an enclosure angle of a little less than 180 degrees, so that first gripper finger component 5 can be pushed onto gripper spindle 1. First gripper finger component 5 has a gripper finger extension 3 which cooperates with a gripper support 2 for holding sheets (not shown) therebetween at a transfer point 4.

Second gripper finger component 6 supplements the enclosure angle of first gripper finger component 5 to form an enclosure angle that is noticeably more than 180 degrees, so that when the gripper finger is installed it is held captive about gripper spindle 1. Second gripper finger component 6 is fastened to gripper spindle 1 by means of a screw 7. Second gripper finger component 6 extends from a contact face 8 to an extension 9 which receives an adjustment screw 10. When installed, second gripper finger component 6 lies against gripper spindle 1 from contact face 8 to a point 11 which is the beginning of extension 9 which is out of contact with gripper spindle 1.

First gripper finger component 5 has a leg 13 and an oppositely disposed, more or less parallel leg which has an inner edge 12 shown by a dashed line in FIG. 1. Leg 13 and inner edge 12 give the first gripper component 5 a U-shaped profile that forms the enclosure angle of 180 degrees or less, so that first gripper component 5 can be pushed radially onto gripper spindle 1.

A first compression spring 14 is disposed between a recess 15 of leg 13 and extension 9. One end of first compression spring 14 is held by a pin 16 of adjustment screw 10. First compression spring 14 exerts a first spring force which can be adjusted by adjustment screw 10. The first spring force tends to spread extension 9 and leg 13 apart, and is in a direction indicated by line 17 which passes through transfer point 4.

First gripper finger component 5 has, approximately in the center of its U-shaped profile, an attachment 18 which receives an adjustment screw 19. Adjustment screw 19 has a tip which lies against contact face 8 thereby creating a screw force in a direction indicated by line 20, which also passes through transfer point 4.

The first spring force and the screw force combine to form a resultant force which lies in a direction shown by line 21 which passes through the center 22 of gripper spindle 1 and transfer point 4.

First gripper finger component 5 has lateral flanges 23 between which the second gripper finger component 6 is held and reinforcing flanges 24.

Between lateral flanges 23 is a receptacle for a second compression spring 25 which exerts a second spring force in a direction indicated by line 26 which is coincident with the direction of the resultant force along line 21. Second compression spring 25 has an underside which is supported by second gripper finger component 6, and an upper side which is supported on an upwardly oriented extension of first gripper component 5 which leads to gripper finger extension 3. Second compression spring 25 presses second gripper finger component 6 against gripper spindle 1, and also pulls first gripper finger component 5 against the opposite side of gripper spindle 1. The second spring force of second compression spring 25 is greater than the first spring force of first compression spring 14.

In a preferred embodiment, as shown in FIG. 1, contact faces of second gripper finger components have rib-shaped or wedge-shaped faces 11,27 with the material between the ribs having a V-shape. First gripper finger component 5 may, according to a further aspect of the invention, additionally be provided with rib-shaped supports, preferably at the point opposite ribs 11, 27, or the ribs may also be distributed over the support. The contact faces of both gripper finger components 5, 6 may, alternatively, have circular profiles.

In the embodiment shown in FIG. 1, the spring force of second compression spring 25 is adjustable. For this purpose, second compression spring 25 is mounted on a supporting element having a shaft 35*a* connected to a wedge-shaped head 35*b* with a wedge face 35*c* which lies against and is in sliding contact with a wedge face 29*a* of a wedge 29 which cooperates with an adjustment screw 28. If adjustment screw 28 is screwed into or out of gripper finger extension 3, wedge 29 is displaced and thus the second spring force is increased or decreased, respectively.

Figure 2:
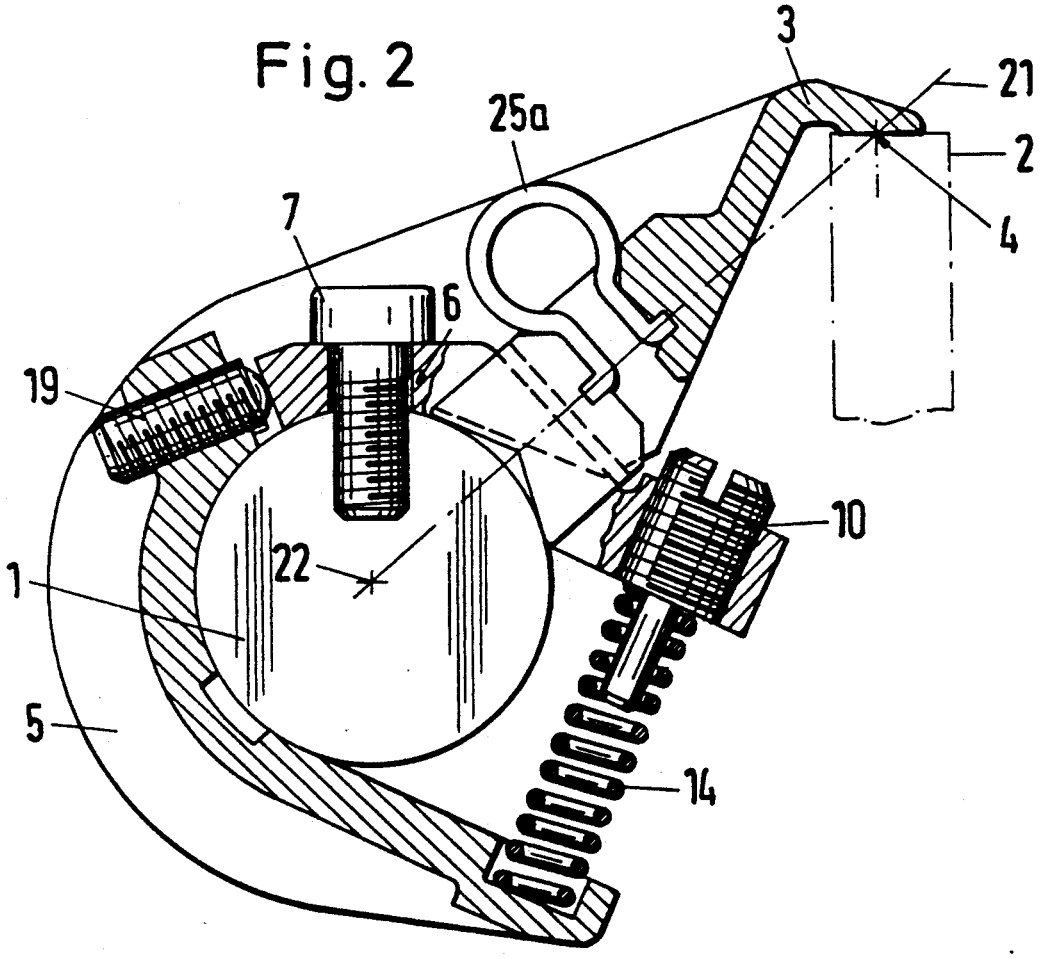
FIGS. 2-5 each show an alternative embodiment of the invention in views corresponding to FIG. 1.
Figure 3:
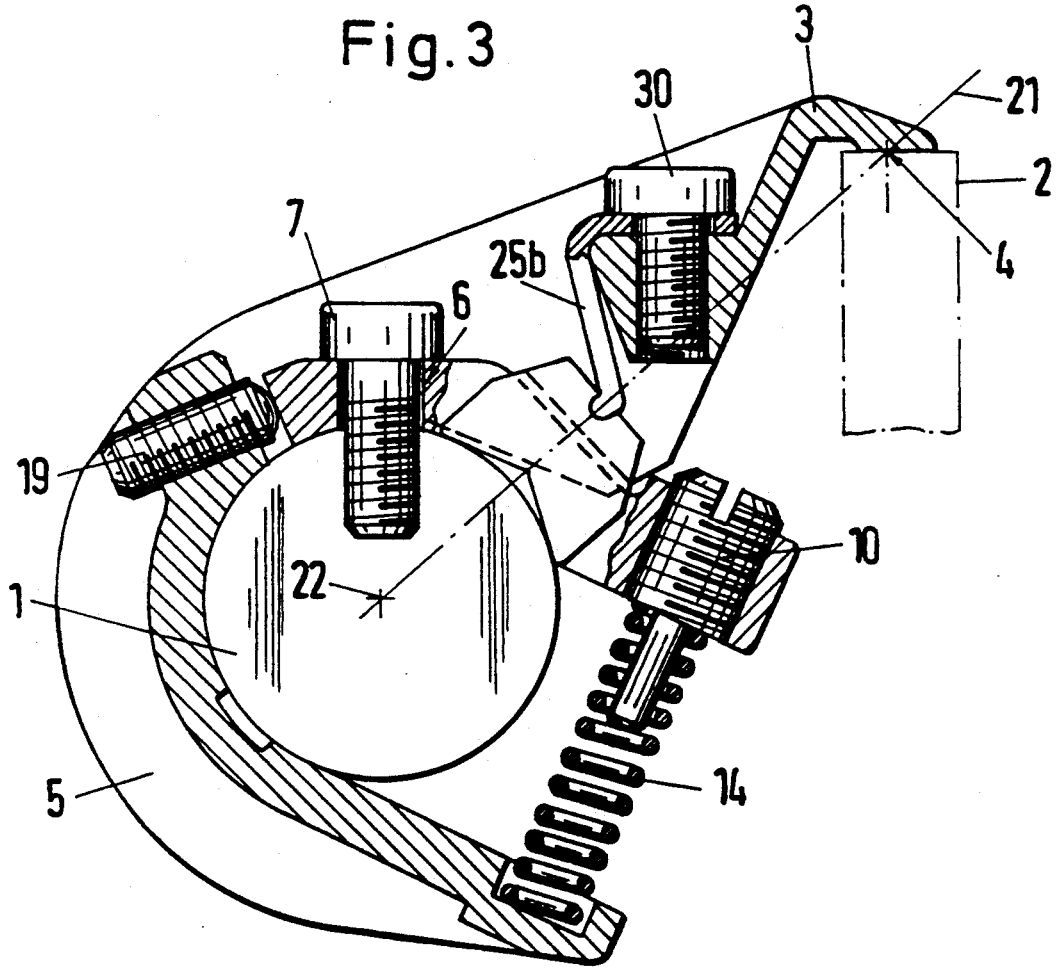
Figure 4:
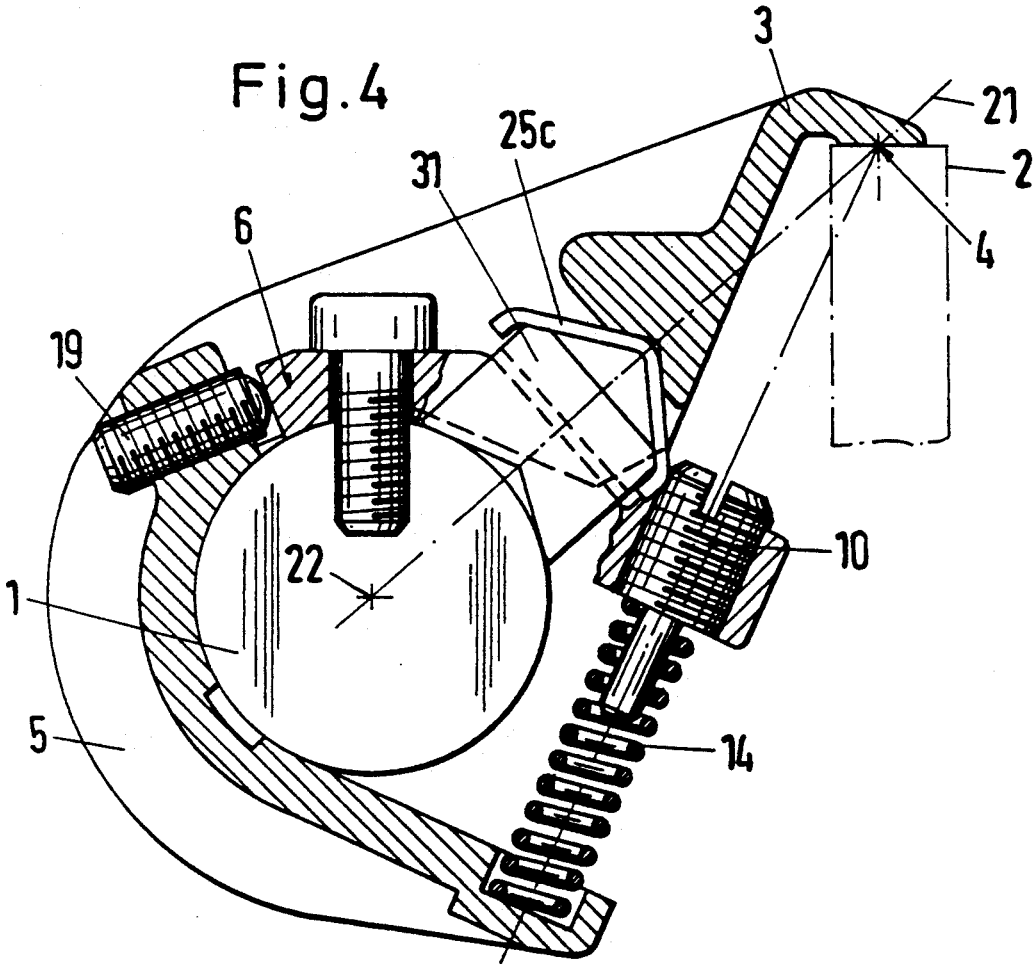
Figure 5:
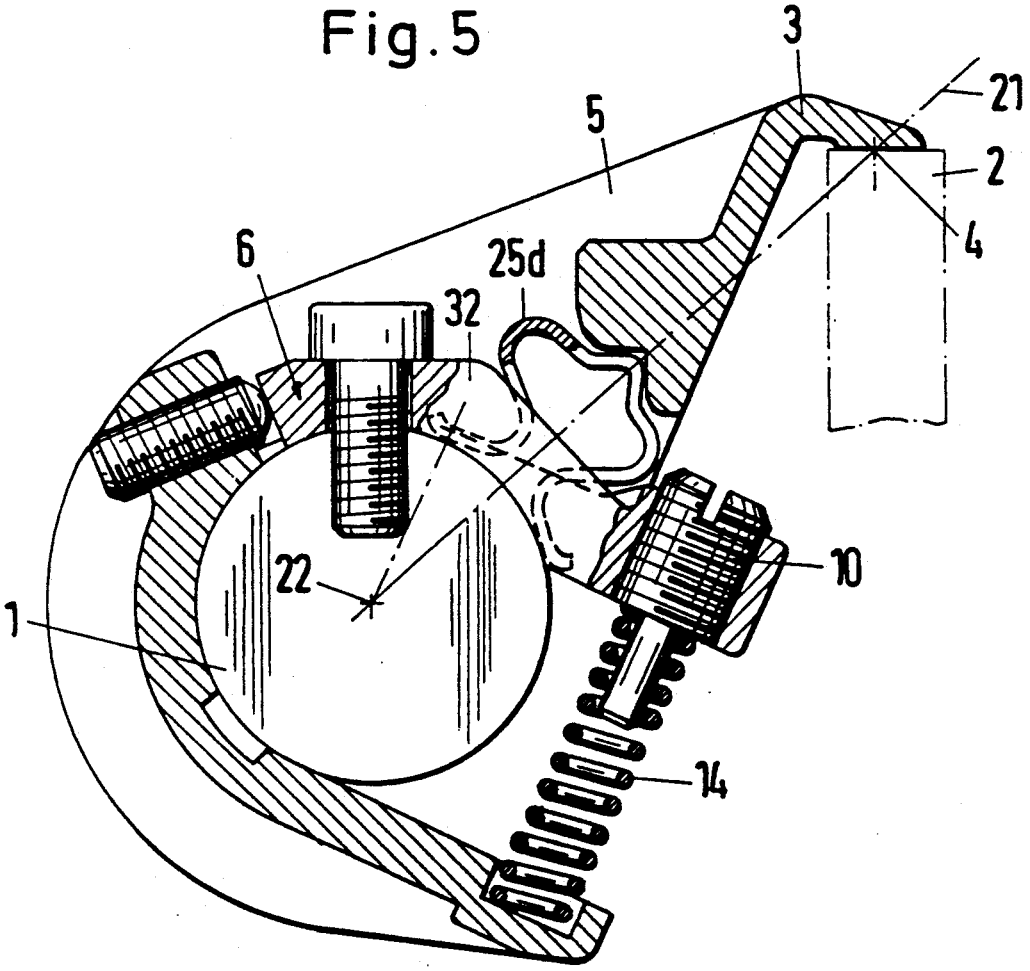

FIGS. 2 to 5 show different embodiments of the second compression spring 25 where the second spring force is not adjustable. In FIG. 2, second compression spring 25*a* is a leg spring with bent ends. In this embodiment the gripper finger extension 3 and the second gripper finger component 6 each have receptacles which engage a bent end of second compression spring 25*a*. In FIG. 3 a second compression spring 25*b* is a leaf spring having a tip that is engaged in a corresponding receptacle in second gripper finger component 6, and an end that is fastened to gripper finger extension 3 by a screw 30. In FIG. 4 a second compression spring 25*c* is a V-shaped leaf spring with legs that are placed around a block-shaped contact member 31 of second gripper finger component 6 and a tip that is engaged in a corresponding recess in gripper finger extension 3. In FIG. 5 a second compression spring 25*d* passes through a corresponding hole in second gripper finger component 6 and is supported directly on gripper spindle 1. All embodiments have in common that one end of the second compression spring is supported by first gripper finger component 5.

It is not necessary for the second compression spring to be supported by second gripper finger component 6 since the latter is fastened to gripper spindle 1 by screw 7. However, in preferred embodiments, second gripper finger component 6 is pressed against gripper spindle 1 by the second compression spring, as shown in FIGS. 1 to 4. The primary purpose of second compression spring 25 is to compensate the play between the gripper finger and gripper spindle 1, and therefore it must exert a force between first gripper finger component 5 and gripper spindle 1 in the direction of lines 21, 26 which essentially coincide in space.

Obviously, numerous and additional modifications and variations of the present invention are possible in light of the above teachings. It is therefore to be understood that within the scope of the appended claims, the invention may be practiced otherwise than as specifically claimed.

What is claimed is:

1. A gripper finger for a gripper spindle in a sheet-fed printing press, comprising:

first and second gripper finger components, said first gripper finger component having a first end and a gripper finger extension which contacts a gripper finger support at a transfer point, said second gripper finger component having a second end, one of said first and second gripper finger components presenting a supporting plane, said first and second gripper finger components cooperating to form an enclosure angle for enclosing a gripper spindle, said first gripper finger component contributing a maximum of 180 degrees to said enclosure angle, and said second gripper finger component supplementing said enclosure angle such that said enclosure angle is greater than 180 degrees;

means for fastening said second griper finger component to the gripper spindle;

a first compression spring, disposed between the first and second ends of the first and second gripper finger components, respectively, for exerting an adjustable, first spring force approximately in a direction of the transfer point;

an adjustment screw threadably engaged with the other of said first and second gripper finger components and having a tip which lies against the supporting plane of said one gripper finger component for exerting a screw force approximately in a direction of the transfer point so that the first spring force and the screw force combine to form a resultant force which is in a direction of a line connecting a center point of the gripper spindle and the transfer point;

a second compression spring disposed for being clamped between said first gripper finger component and the gripper spindle for urging said first gripper finger component against the gripper spindle, said second compression spring exerting a second spring force having a magnitude greater than the magnitude of the first spring force and being in a direction which essentially coincides with the direction of the resultant force and means for adjusting the magnitude of the second spring force, said adjusting means includes a supporting element for said second compression spring which includes a wedge-shaped head having a first wedge face, and a displaceable wedge having a second wedge face in sliding relationship with said first wedge face.

2. A gripper finger as defined in claim 1, wherein said first gripper finger component has lateral flanges defining a recess therebetween and said second gripper finger component is accommodated in the recess between said lateral flanges.

3. A gripper finger as defined in claim 1, wherein said supporting plane is presented by said second gripper finger component and said adjustment screw is threadably engaged with said first gripper finger component.

* * * * *